US005193378A

United States Patent [19]

Ritter et al.

[11] Patent Number: 5,193,378

[45] Date of Patent: Mar. 16, 1993

[54] DEVICE FOR BENDING ROD-LIKE MATERIAL TO FORM CONCRETE REINFORCEMENTS

[75] Inventors: Gerhard Ritter; Klaus Ritter; Gerhard Schmidt, all of Graz, Austria

[73] Assignee: EVG Entwicklungs-u Verwertungs-Gesellschaft m.b.h, Graz, Austria

[21] Appl. No.: 659,298

[22] PCT Filed: Aug. 30, 1990

[86] PCT No.: PCT/AT90/00086

§ 371 Date: May 1, 1991

§ 102(e) Date: May 1, 1991

[87] PCT Pub. No.: WO91/04112

PCT Pub. Date: Apr. 4, 1991

[30] Foreign Application Priority Data

Sep. 20, 1989 [AT] Austria ..... 2205/89

[51] Int. Cl.[5] ..... B21D 7/022

[52] U.S. Cl. ..... 72/294; 72/307; 72/217; 72/26; 72/3; 72/426

[58] Field of Search ..... 72/294, 307, 426, 388, 72/217-219, 26, 3

[56] References Cited

U.S. PATENT DOCUMENTS

| | | | |
|---|---|---|---|
| 3,052,277 | 9/1962 | Stegmann | 72/307 |
| 3,373,587 | 3/1968 | Shubin | 72/307 |
| 3,395,846 | 8/1968 | Mille | 72/307 |
| 3,440,847 | 4/1969 | Giordano | 72/26 |
| 3,493,016 | 2/1970 | Ott | 72/307 |
| 4,782,684 | 11/1988 | Benton | 72/217 |
| 5,009,097 | 4/1991 | Del Fabro | 72/307 |

FOREIGN PATENT DOCUMENTS

| | | |
|---|---|---|
| 108695 | 5/1984 | European Pat. Off. . |
| 0231092 | 8/1987 | European Pat. Off. . |
| 88046966 | 9/1989 | Fed. Rep. of Germany . |

*Primary Examiner*—Daniel C. Crane

*Attorney, Agent, or Firm*—Frishauf, Holtz, Goodman & Woodward

[57] ABSTRACT

Apparatus for bending rod-shaped material to form concrete-reinforcement elements, having a frame (3) for supporting a material feed device (4) and having a bearer for bending members, which bearer is mounted on the frame so as to be rotatable about the axis of feed, is adjustable relative to the frame and is constructed as a material supporting table (10) which is adjustable in a predetermined angular position relative to the frame, on which material supporting table a cutting device (8) is provided upstream of the bending members (15,16) in the material feed direction for cutting off the rod-shaped material from the line of material after the bending operation.

4 Claims, 2 Drawing Sheets

DEVICE FOR BENDING ROD-LIKE MATERIAL TO FORM CONCRETE REINFORCEMENTS

FIELD OF THE INVENTION

The invention relates to an apparatus for bending rod-shaped material to form bent concrete-reinforcement elements, such as stirrups, having a frame for supporting a material feed device and having a bearer for bending members, which bearer is mounted on the frame so as to be rotatable about the axis of feed and is adjustable relative to the frame.

BACKGROUND

In an apparatus of this type, known from U.S. Pat. No. 4,782,684, Benton, the bearer for the bending members has a driven rotatable disc which is mounted on the frame so as to be rotatable in both directions about the axis of feed and is provided with a passage aperture for the rod-shaped material. Extending from the rotatable disc is an arm, which is provided with a slide guide which is penetrated by the material and is aligned with the rotatable disc aperture. At its free end, the bearer bears a bending head which is fitted with bending mandrels which can be rotated or swivelled about an axis perpendicular to the guide. The known design primarily has the disadvantage that bars with relatively large limb lengths cannot be effectively supported by the bearer arm and are at risk of becoming deformed under their own weight. On the other hand, due to the lack of adequate support, no possibility is provided of counteracting or compensating for a spring-back tendency of the material during bending. Finally, in the known construction, a cutting-off device for the bent element is provided on a separate frame away from the bending head, which cutting-off device is complicated in construction and susceptible to malfunction.

THE INVENTION

The object of the invention consists in avoiding the disadvantages described and providing an apparatus of the type specified in the introduction which allows rod-shaped material to be bent satisfactorily in different bending planes and with any desired limb lengths and allows the resulting bent elements or stirrups to be cut off in a simple manner. At the same time, the invention is intended to allow the continuous bending of spatial reinforcements and so-called stirrup cages or binders.

Briefly, the apparatus according to a feature of the invention has a bearer which is constructed as a material supporting table. The table is adjustable in a predetermined angular position relative to the frame. A cutting device is provided on the table upstream of the bending members in the material feed direction for cutting off the rod-shaped material from a line of material after the bending operation. The table is rotatably supported from the frame by a tubular element, placed coaxially with the axis of feed of rod-shaped material to permit angular rotation of the material supporting table. The table surface is at least as large as the surface enclosed by the contour of the reinforcement stirrup.

The invention advantageously provides an adjustable supporting surface for the bent reinforcement elements or stirrups which guarantees satisfactory forming of the elements without the risk of deformation, it being possible for the elements to be cut off reliably without great constructional expenditure and without delay.

In accordance with a feature of the invention, an electrical connection strip is provided on the supporting table with clearance from the bending members for providing electrical contact with the bent material, via which strip the rotational movement of the table can be controlled. By this means, in the case of the bent element being unintentionally lifted up from the supporting table, readjustment of the supporting table into renewed contact with the element is achieved.

According to a further feature of the invention, a receiver is provided below the supporting table for reinforcement elements or stirrups dropping downwards when the supporting table is in the horizontal position, the receiver preferably being rotatable.

DRAWINGS

The invention is described in greater detail below by way of an exemplary embodiment with reference to the drawings, in which:

FIG. 1 shows a diagrammatic perspective view of a bending apparatus in accordance with the invention, and FIGS. *2a–2c* show the bending apparatus according to the invention with different arrangements of the supporting table defining the bending plane relative to the material feed plane.

DETAILED DESCRIPTION

Figure 1:
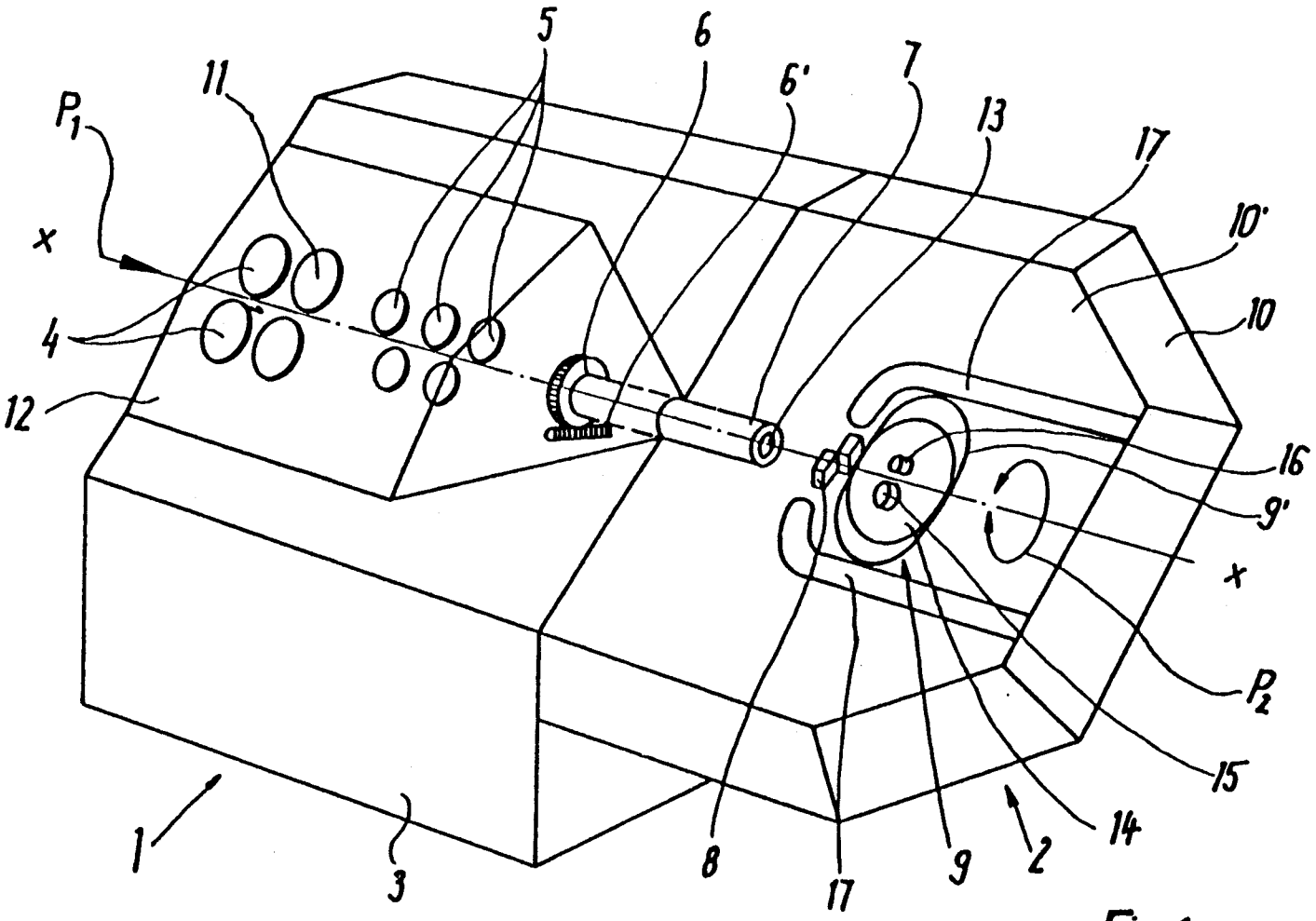
Figure 2A:
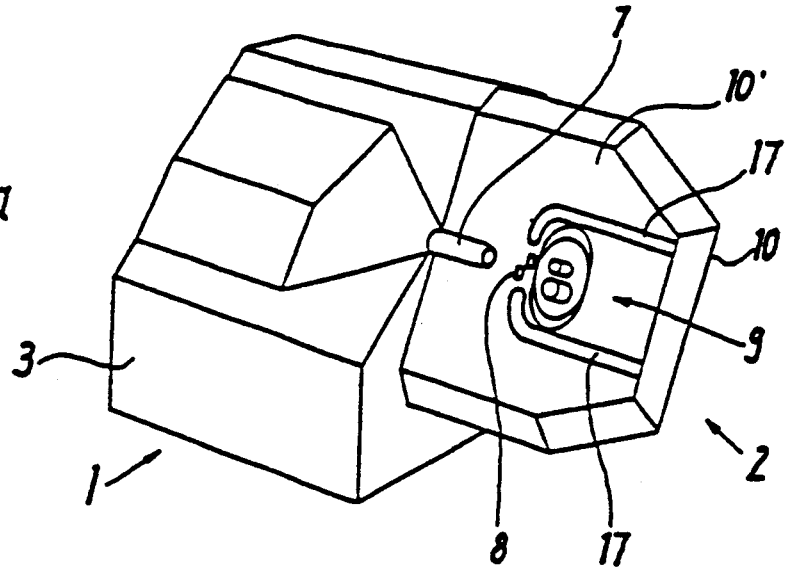
Figure 2B:
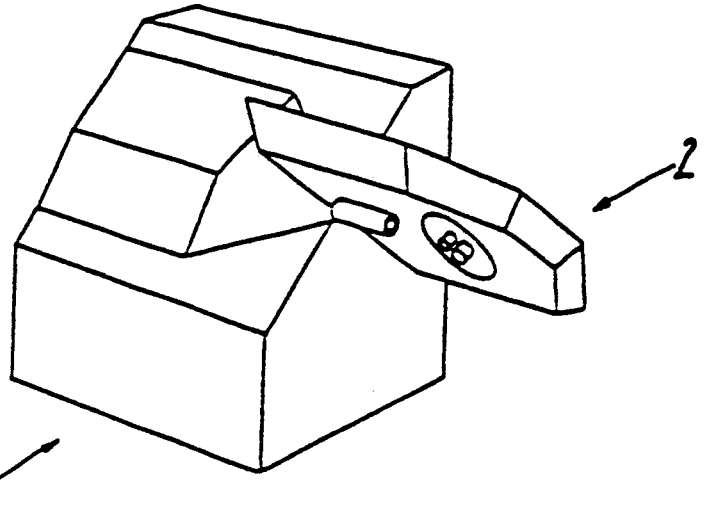
Figure 2C:
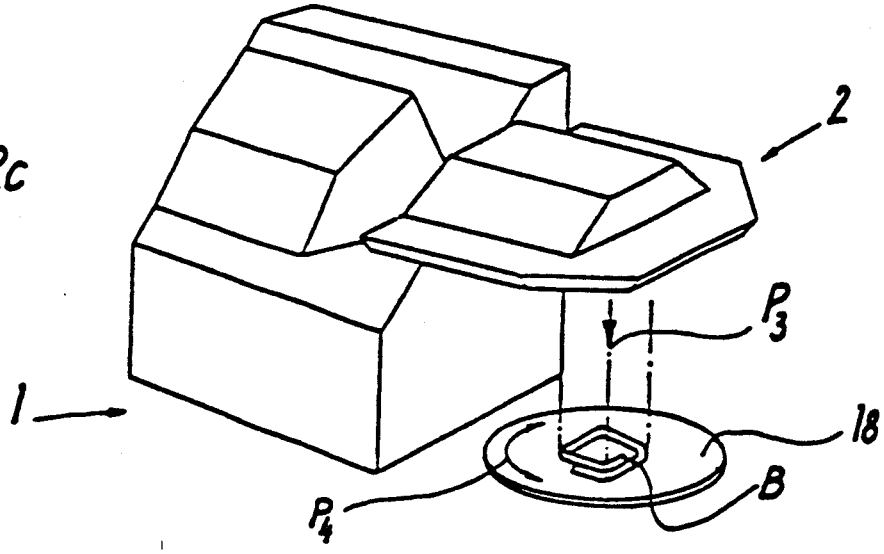

In accordance with FIG. 1, rod material to be bent is fed to the bending apparatus in the direction of the arrow $P_1$ from a material stock (not illustrated) via a straightening device (likewise not illustrated) and forwarded along an axis of feed X—X.

The bending apparatus consists essentially of two parts 1 and 2, part 1 being arranged in a stationary manner and part 2 being connected to part 1 so as to be rotatable about an axis of rotation which coincides with the axis of feed X—X and corresponds to the double arrow $P_2$. The part 1 consists of a stationary frame 3 which bears a set 4 of feed rollers, an additional set 5 of straightening rollers arranged downstream of the set 4 of feed rollers, for compensating any deformations of the rod material by the feed rollers, and a rotary drive 6 for the part 2. Part 2 is coupled to part 1 so as to be rotatable on the part 1 by means of an elongated, tubular bearing or support element 7.

The part 2 consists essentially of a supporting table 10 which bears a cutting device 8 and a bending head 9.

A measurement wheel 11 is expediently integrated in the set 4 of feed rollers, via which measurement wheel the length of the rod material passing through is recorded and the cutting device 8 is actuated, after the predetermined length of the material to be bent has been reached, in order to cut off the finished bar from the line of material by said cutting device. It is additionally possible within the framework of the invention to arrange a measurement wheel, provided with a corresponding counter-roller, on the supporting table 10 directly upstream of the cutting device 8.

In order to avoid soiling, the set 4 of feed rollers and the set 5 of straightening rollers are covered by a covering hood 12 which can be removed for the purpose of servicing.

The rotary drive 6 for the supporting table 10 is constructed in a known manner. A drive worm 6' is indicated diagrammatically only by way of example. The bearing element 7 of the supporting table 10 is provided with a longitudinal bore 13 coaxial with the axis of feed X—X in order to allow unhindered passage of the rod material to be bent from the set 5 of straightening rollers to the bending head 9.

The cutting device 8 is likewise constructed in a known manner and is situated immediately upstream of the bending head 9, in order also to enable extremely short end limbs of the stirrups to be produced. Due to the arrangement of the cutting device 8 on the rotatable supporting table 10 and in the axis of feed X—X, the cutting device 8 can rapidly cut off the finished bar from the line of material without additional expenditure on positioning.

The bending head 9 has a bending-head plate 14 which is movable in a guide 9' and on which there are arranged a stationary bending mandrel 15 and a bending bolt 16 which is swivellable for bending the rod. Bending tools of different construction can also be used within the framework of the invention.

The supporting table 10 has a table surface 10' which is at least as large as the surface bounded by the contour of the stirrups to be produced and defines the bending plane. In all positions of the supporting table 10 with the table surface 10' facing upwards, the supporting table supports the supplied bars and resulting stirrups bars and limbs during the bending operation. In the case of particularly large bars, the supporting table 10, together with the frame 3, forms a support for the stirrups. Additionally arranged on the supporting table 10 with clearance from the bending head is a two-part contact strip 17 which is only illustrated diagrammatically and which controls the rotational movement of the supporting table 10 and thus the three-dimensional position of the bending plane when electrical contact is made with the element, to be produced, i.e. the stirrup specifically even during bending, in order to readjust the table surface 10' of the supporting table 10, for example when the element deviates from the bending plane, into renewed contact with the element and thus to guarantee the production of flat stirrups.

FIGS. *2a–2c* illustrate various relative positions of the supporting table 10 and thus of the bending plane in relation to the feed plane which is defined by the arrangement of the set 4 of feed rollers and the set 5 of straightening rollers with the stationary frame 3 and is unalterable. The bending machine illustrated in FIG. 1 shows a coincidence of bending plane and feed plane which is to be considered as the basic setting.

FIG. *2a* shows only a small deviation between the bending plane and the feed plane, which causes an intentional overcompensation in the bending and a counter-deformation of the rod material, for example in the production of crossed stirrups, as a result of the oblique position of the table surface, and thus prevents an undesired spreading of the stirrup limbs in the finished stirrup.

In FIG. *2c*, the supporting table 10 is rotated out of the basic position in accordance with FIG. 1 to the extent that the supporting table 10 is almost horizontal with the table surface facing downwards. Since the bending tools 15, 16 face downwards in this position, it is possible to allow stirrup B, for example, to drop without an additional catching device in the vertical direction $P_3$ onto a receiver device 18 constructed, for example, as a turntable. The receiver turntable 18 is rotatable corresponding to the double arrow $P_4$, in order to allow orderly stacking of the stirrups B.

In the position of the supporting table 10 illustrated in FIG. *2c*, it is additionally possible to produce spatial reinforcements and stirrup cages or binders in a continuous operating process. In this case, it is also expedient to match the receiver turntable 18 in its rotational movement corresponding to the double arrow $P_4$ to the bending operation.

It is understood that the invention is not restricted to the exemplary embodiments illustrated; on the contrary, these can be modified in various ways within the framework of the general concept of the invention.

We claim:

1. Apparatus for bending rod-shaped material to form a concrete reinforcement stirrup, comprising a frame (3) for supporting a material feed device (4, 5);

bending members (16);

a bearer element (10) retaining said bending members (16), said bearer element being secured on the frame to be rotatable about the axis of feed of said rod-shaped material and to be angularly adjustable relative to the frame, said bearer element including a material supporting table (10) which has a table support surface (10') which is at least as large as the surface enclosed by the contour of a reinforcement stirrup limb to be bent by said bending members (15, 16) and supporting said bent limb;

a rotary bearing (7) rotatably supporting said material supporting table (10) with respect to the frame and providing for positioning said material supporting table in a predetermined angular position relative to the frame, said rotary bearing including a tubular guide coaxial with the axis of feed of the rod-shaped material;

a material cutting device (8) located upstream of the bending members (16) on the material supporting table (10) in material feed direction, for cutting off said rod-shaped material from a line of material after the bending operation; and electrical connecting strip means (17) located on said support table (10) and having terminal ends positioned with clearance from said bending members (16), and located to form an electrical contact with material being bent, for control of the rotational movement of the table (10) in accordance with the position of said material on said table.

2. The apparatus of claim 1, further comprising a receiver (18) located below said material supporting table (10) for reception of reinforcement stirrups dropping downwardly when the bearer element is in a horizontal position with the supporting table surface (10') of said bearer element (10) facing downwardly.

3. The apparatus of claim 2, wherein said receiver (18) is rotatable.

4. The apparatus of claim 1, wherein said apparatus comprises a two-part apparatus, of which one part includes said frame (3) including said material feed device (4, 5), and a second part includes said material supporting table, said bending members and said cutting device, said rotary bearing (7) coupling said first and second parts.

* * * * *